US007237324B2

(12) United States Patent
Matsukawa et al.

(10) Patent No.: US 7,237,324 B2
(45) Date of Patent: Jul. 3, 2007

(54) METHOD FOR MANUFACTURING CHIP RESISTOR

(75) Inventors: Toshiki Matsukawa, Fukui (JP); Yasuharu Kinoshita, Fukui (JP); Shoji Hoshitoku, Osaka (JP); Masaharu Takahashi, Osaka (JP); Yoshinori Ando, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 385 days.

(21) Appl. No.: 10/474,419

(22) PCT Filed: Jan. 14, 2003

(86) PCT No.: PCT/JP03/00195

§ 371 (c)(1),
(2), (4) Date: Oct. 9, 2003

(87) PCT Pub. No.: WO03/060929

PCT Pub. Date: Jul. 24, 2003

(65) Prior Publication Data

US 2004/0113750 A1 Jun. 17, 2004

(30) Foreign Application Priority Data

Jan. 15, 2002 (JP) ..... 2002-005598

(51) Int. Cl.
*H01C 17/06* (2006.01)

(52) U.S. Cl. ..... 29/621; 29/412; 29/610.1; 29/620; 219/121.67; 219/121.68

(58) Field of Classification Search ..... 29/610.1, 29/611–613, 619–621, 412, 414, 415, 417, 29/640.1; 338/22 R, 22 SD, 52, 204, 291, 338/293, 312, 313, 314, 322, 328, 332; 219/121.6, 219/121.67, 121.68, 121.69; 438/33, 113, 438/458

See application file for complete search history.

(56) References Cited

U.S. PATENT DOCUMENTS

| | | | | |
|---|---|---|---|---|
| 4,792,781 | A | 12/1988 | Takahashi et al. | |
| 5,850,171 | A * | 12/1998 | Lin et al. | 338/320 |
| 5,907,272 | A * | 5/1999 | McGuire | 338/22 R |
| 6,005,474 | A * | 12/1999 | Takeuchi et al. | 338/320 |
| 6,144,287 | A * | 11/2000 | Komeda | 338/195 |
| 6,238,992 | B1 * | 5/2001 | Yamada | 438/382 |
| 6,242,999 | B1 * | 6/2001 | Nakayama et al. | 338/309 |
| 6,535,106 | B2 * | 3/2003 | Teramae | 338/309 |
| 6,703,683 | B2 * | 3/2004 | Tanimura | 257/536 |
| 6,724,295 | B2 * | 4/2004 | Tsukada | 338/309 |
| 6,727,111 | B2 * | 4/2004 | Tsukada | 438/33 |
| 6,935,016 | B2 * | 8/2005 | Hashimoto et al. | 29/619 |

FOREIGN PATENT DOCUMENTS

| | | |
|---|---|---|
| JP | 60-166102 | 11/1985 |
| JP | 63-172401 A | 7/1988 |
| JP | 03-30409 | 3/1991 |
| JP | 05-267025 A | 10/1993 |
| JP | 11-312601 A | 11/1999 |
| WO | WO 0154143 A1 * | 7/2001 |

OTHER PUBLICATIONS

International Search Report for application No. PCT/JP03/00195 dated Apr. 30, 2003.

* cited by examiner

*Primary Examiner*—A. Dexter Tugbang
*Assistant Examiner*—Livius R. Cazan
(74) *Attorney, Agent, or Firm*—RatnerPrestia

(57) ABSTRACT

A multiple chip resistor is manufactured in the following method. First electrode layers are formed on a first surface of a substrate. Resistor elements electrically connected to the first electrode layers, respectively, are formed on the first surface of the substrate. Slits are formed in the substrate for separating the first electrode layers. Edge electrodes connected to the first electrode layers at the edges of the slits, respectively, are formed on respective edges at the slits of the substrate. The substrate is divided at the slits into strip substrates. Portions of the edge electrodes are removed for electrically isolating the resistor elements from each other. The method provides the edge electrodes on each strip substrate with an improved dimensional accuracy, hence allowing the edge electrodes to be isolated electrically from each other. Consequently, the multiple chip resistor is prevented from being mounted defectively when the resistor is surface-mounted.

13 Claims, 25 Drawing Sheets

METHOD FOR MANUFACTURING CHIP RESISTOR

THIS APPLICATION IS A U.S. NATIONAL PHASE APPLICATION OF PCT INTERNATIONAL APPLICATION PCT/JP03/00195.

FIELD OF THE INVENTION

The present invention relates to a method of manufacturing a multiple chip resistor having an array of resistor elements provided on a single substrate.

BACKGROUND OF THE INVENTION

A conventional method of manufacturing a multiple chip resistor is disclosed in Japanese Utility Model Laid-Open No. 3-30409 as shown in FIGS. 31 to 33. In the method, both sides of a substrate 120 of a pre-baked green sheet of, e.g., a ceramic material is provided with longitudinal slit lines 122 and traverse slit lines 123. The substrate is separated along the longitudinal slit lines 122 into rectangular strips each of which includes chips 121 which are connected. Each strip is separated along the traverse slit lines 123 into the chips 121. Substantially-oval apertures 128 are provided at the intersections between the longitudinal slit lines 122 and the traverse slit lines 123 and/or intermediates across the longitudinal slit lines 122 in the substrate 120. Then, the substrate 120 is baked and divided along the longitudinal slit lines 122 into the strips. Then, a pair of electrode terminals 127 extending to both the upper and lower sides of each chip are provided on both edges along the longitudinal slit lines 122 of each chip of the strip. Then, a resistor film 124 is printed on the upper side of the chip so as to partially overlap the electrode terminals 127, is baked, and is subjected to laser trimming. Then, the resistor film 124 is covered with a glass coating.

In the conventional method of manufacturing the multiple chip resistor, the substrate 120 as a green sheet is provided with the longitudinal slit lines 122, the traverse slit lines 123, and the substantially oval apertures 128 and is then baked. This method may cause a variation in the composition of the substrate 120 and a change in its baking temperature, thus resulting in dimensional errors of the longitudinal slit lines 122, the traverse slit lines 123, and the oval apertures 128. In order to avoid the above errors by the conventional method, the chips on the substrate are classified by their dimensions into levels in a longitudinal direction and a traverse direction, and then, various screen printing masks corresponding to the levels for the electrode terminals 127, the resistor film 124, and the glass coating are prepared. The screen printing masks have to be replaced from one to another with reference to the levels of the dimensional classification of the chips on the substrate, thus making the resistor hard to manufacture.

SUMMARY OF THE INVENTION

A multiple chip resistor is manufactured in the following method. First electrode layers are formed on a first surface of a substrate. Resistor elements electrically connected to the first electrode layers, respectively, are formed on the first surface of the substrate. Slits are formed in the substrate for separating the first electrode layers. Edge electrodes connected to the first electrode layers at the edges of the slits, respectively, are formed on respective edges at the slits of the substrate. The substrate is divided at the slits into strip substrates. Portions of the edge electrodes are removed for electrically isolating the resistor elements from each other.

DETAIL DESCRIPTION OF THE PREFERRED EMBODIMENTS

Exemplary Embodiment 1

Figure 1:
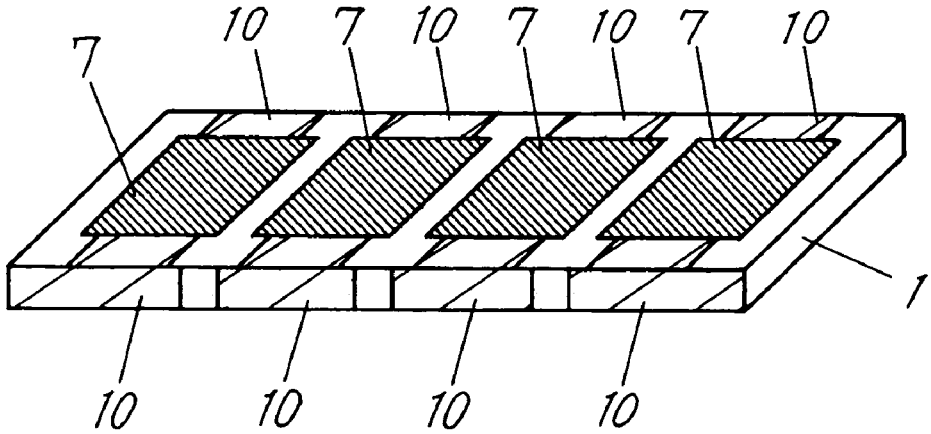
FIG. 1 is a perspective view of a multiple chip resistor manufactured by a method according to Exemplary Embodiment 1 of the present invention.
Figure 2:
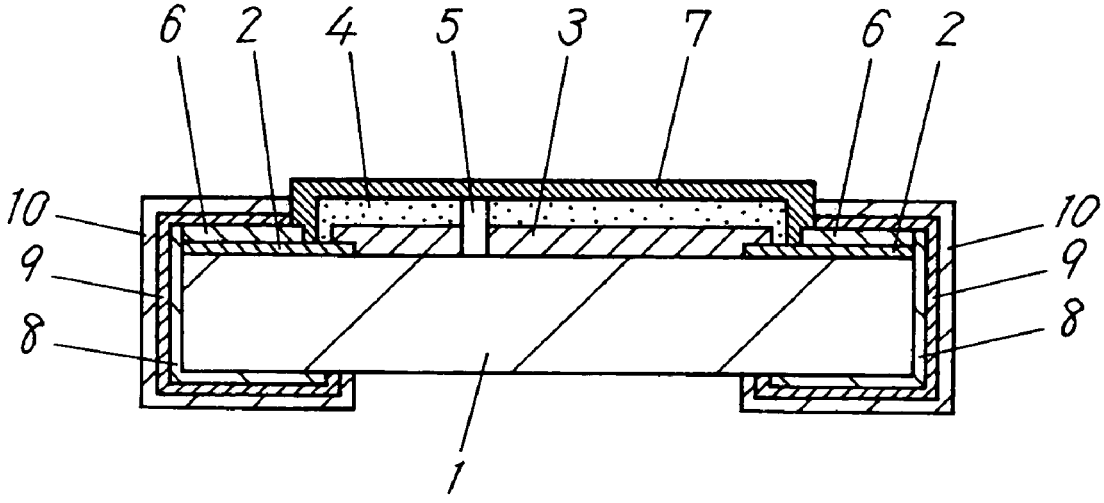
FIG. 2 is a cross sectional view of the multiple chip resistor according to Embodiment 1.

FIG. 1 is a perspective view of a multiple chip resistor manufactured by a method according to Exemplary Embodiment 1 of the present invention. FIG. 2 is a cross sectional view of the resistor. The resistor includes a substrate 1 separated from a substrate shaped in a sheet of baked aluminum of 96% purity by dividing the substrate along first dividing sections and second dividing sections orthogonal to the first dividing sections. The substrate 1 has pairs of upper electrode layers 2 made of silver-based material provided on the upper surface of the substrate 1. The substrate 1 includes resistor elements 3 made of ruthenium oxide material provided on the upper surface of the substrate 1. The resistor elements 3 partially overlap, i.e., are electrically connected to the upper electrode layers 2. The resistor elements 3 are covered entirely with first protective layers 4 made of glass-based material, respectively. The resistor element 3 and the first protective layer 4 have a trimming trench 5 provided in the element 3 and the layer 4 for adjusting a resistance of the resistor element 3 between the upper electrodes 2. The upper electrodes 2 are overlapped by adhesive layers 6 made of silver-based conductive resin material having edges flush with the edge surfaces of the substrate 1 and the upper electrodes 2, respectively. The first protective layer 4 is covered with a second protective layer 7 made of resin-based material which overlaps partially the adhesive layers 6. The substrate 1 has pairs of edge electrodes 8 provided on both edge surfaces of the substrate 1. The edge electrodes 8 are electrically connected with the upper electrodes 2, respectively. The edge electrodes 8 have substantially L-shapes to cover the edge surfaces of the substrate 1, the upper electrodes 2, and the adhesive layers 6 as well as the lower surface of the substrate 1. Each combination of the adhesive layer 6 and the edge electrode 8 are covered at the upper surface with a first plating layer 9 of nickel which has substantially a squared C-shape. The first plating layer 9 is covered with a second plating layer 10 of tin which has substantially a squared C-shape.

A method of manufacturing the resistor of Embodiment 1 of the invention will be described in more detail.

Figure 3:
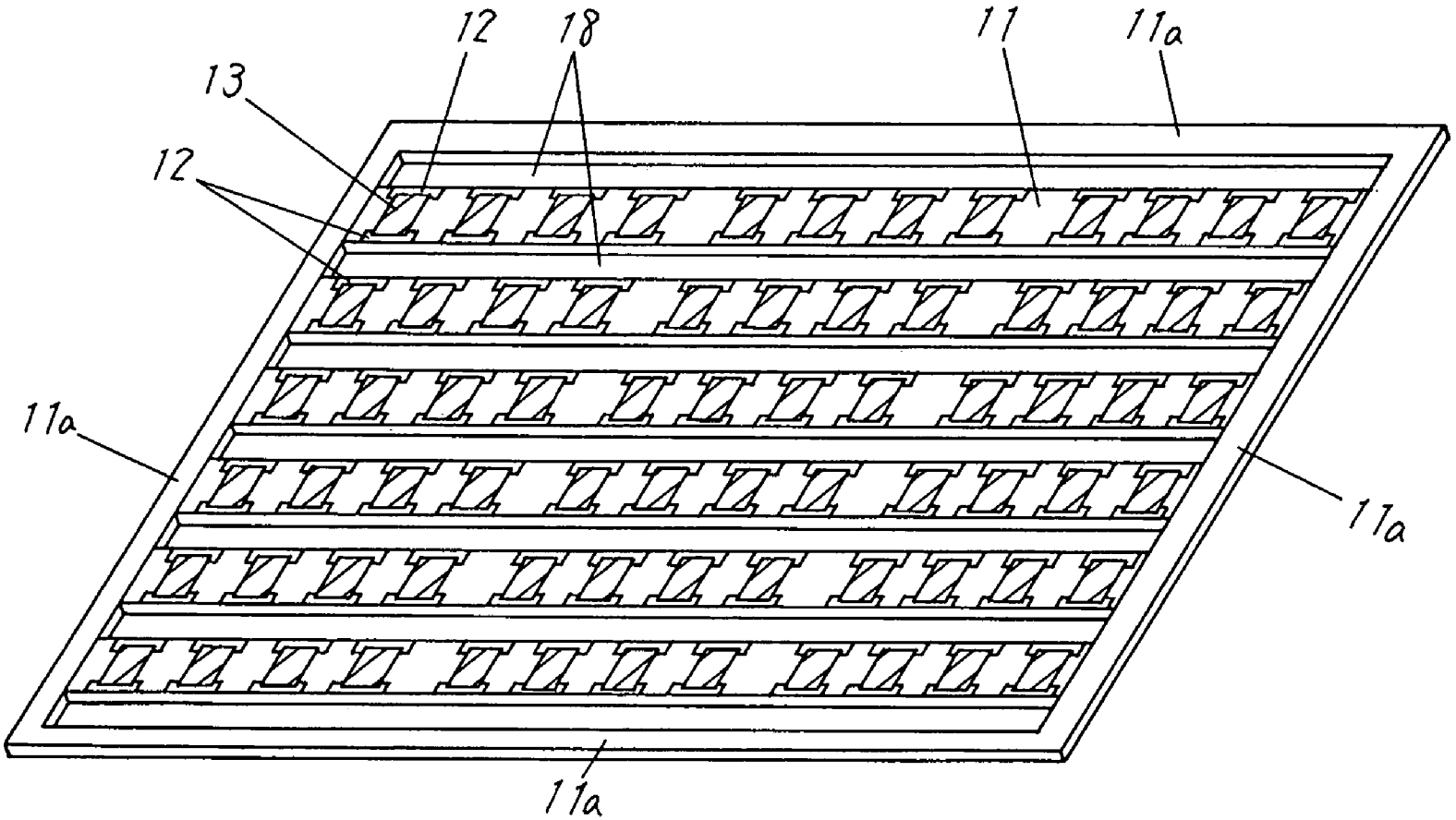
FIG. 3 is an upper perspective view of a sheet substrate used in the method of Embodiment 1.
Figure 12:
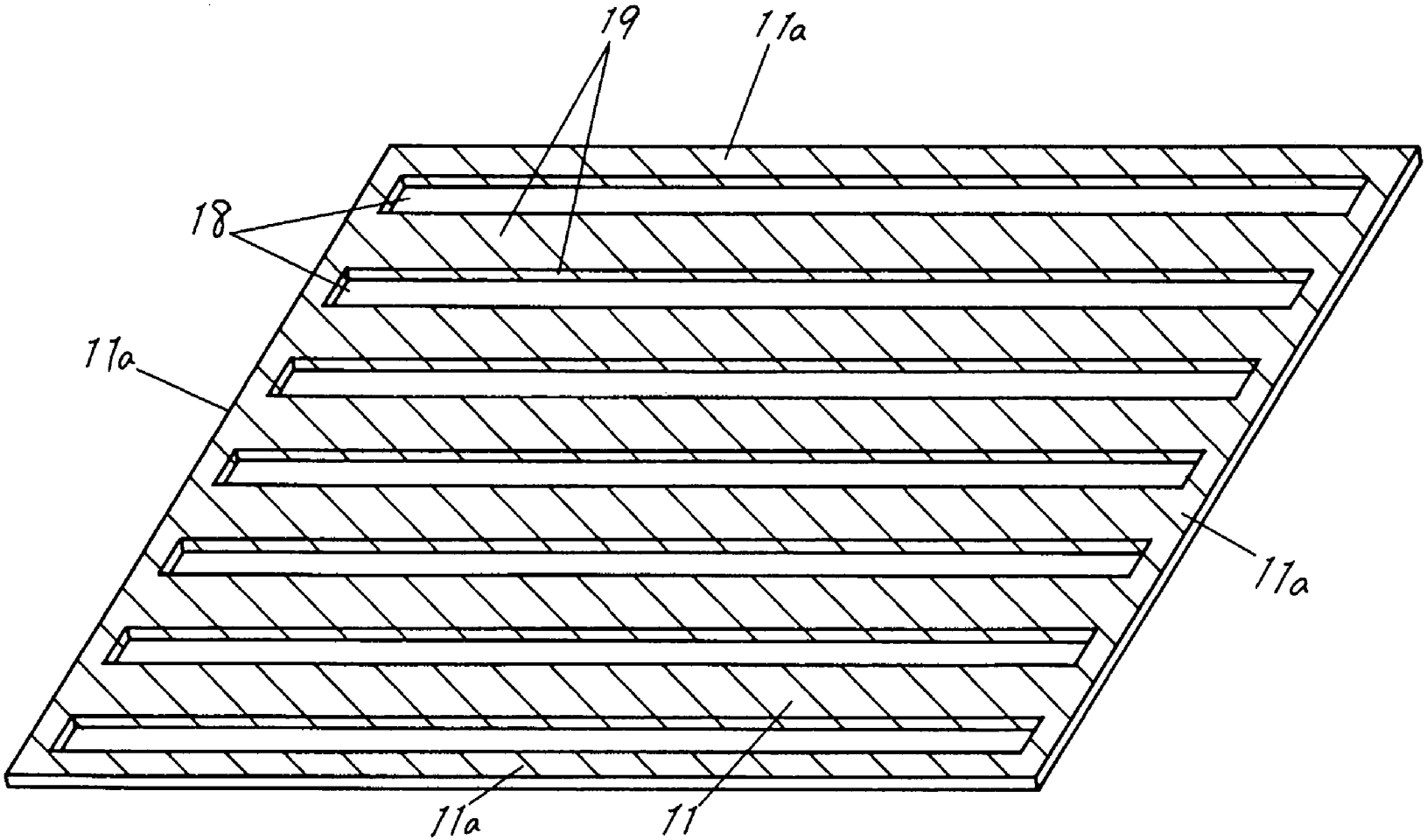
FIG. 12 is a lower perspective view of the substrate used in the method of Embodiment 1.
Figure 13:
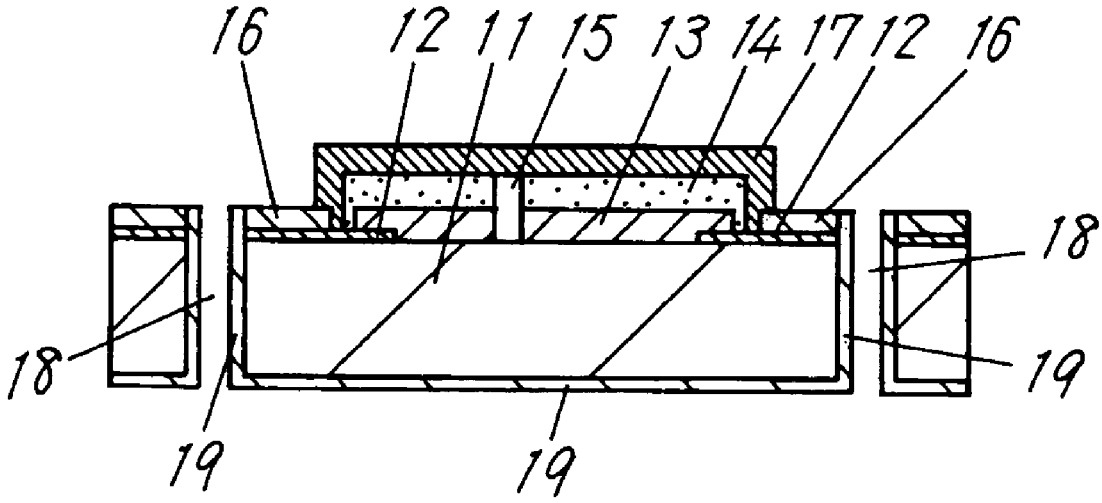
FIG. 13 is a cross sectional view of the resistor for showing the method of manufacturing the resistor of Embodiment 1.
Figure 14:
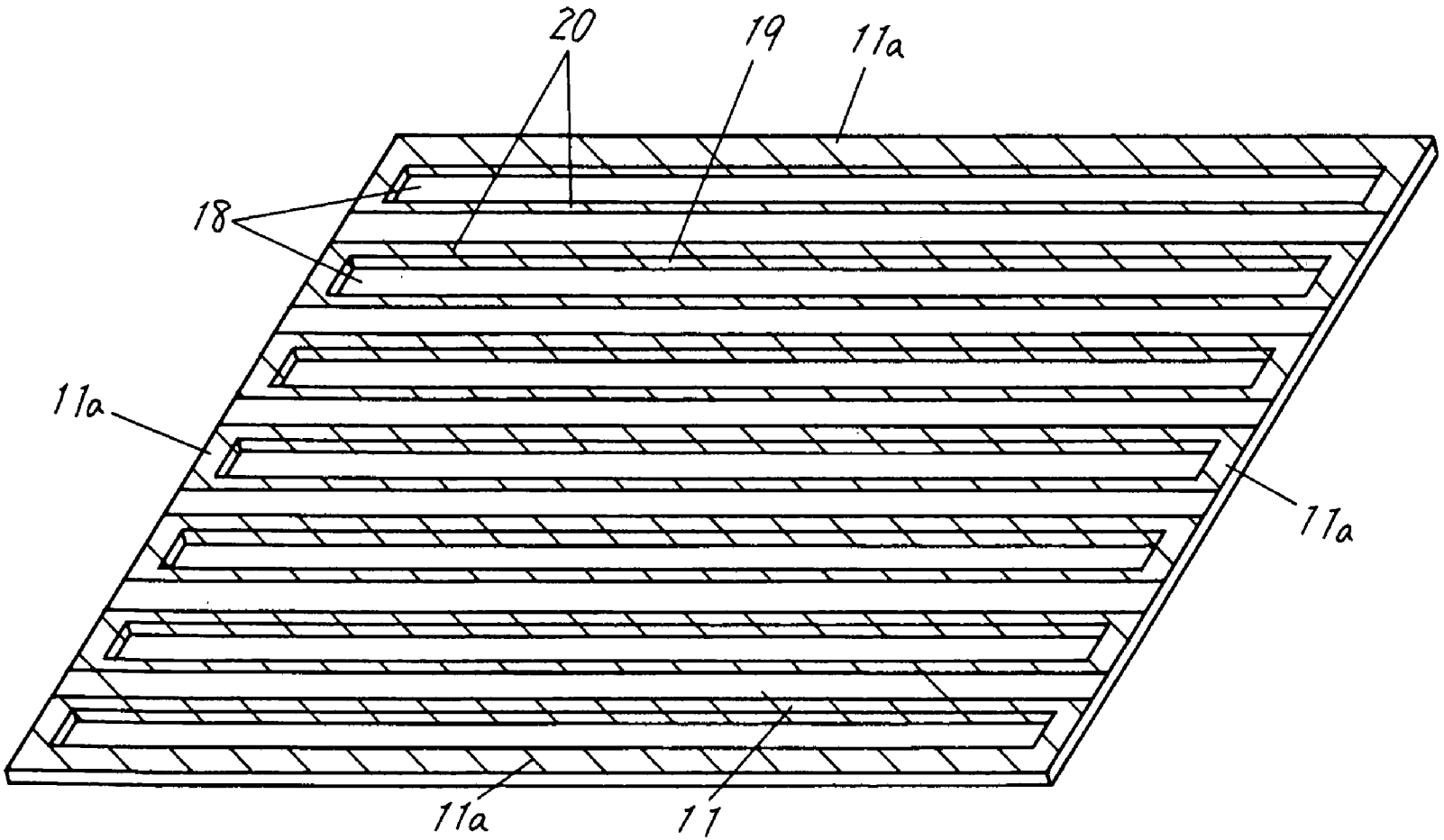
FIG. 14 is a lower perspective view of the substrate used in the method of Embodiment 1.
Figure 15:
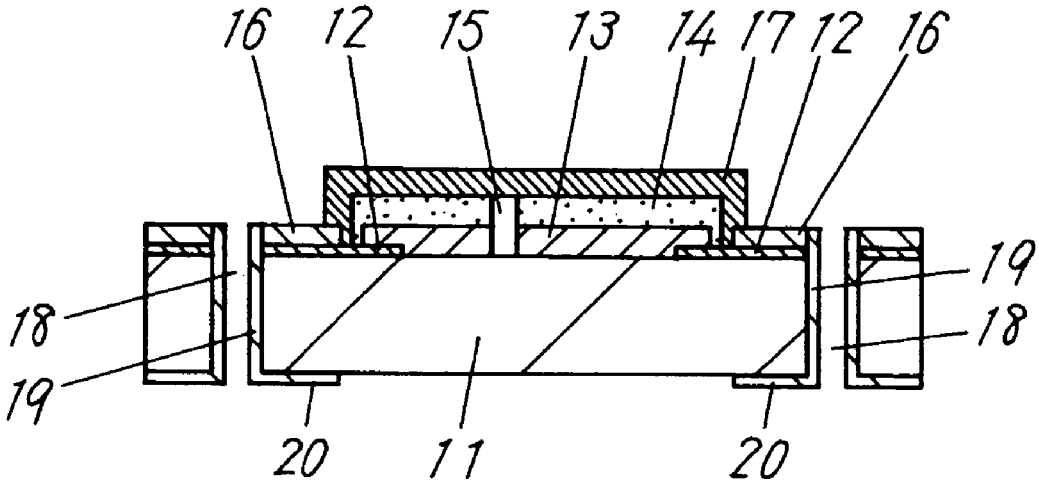
FIG. 15 is a cross sectional view of the resistor for showing the method of manufacturing the resistor of Embodiment 1.
Figure 16:
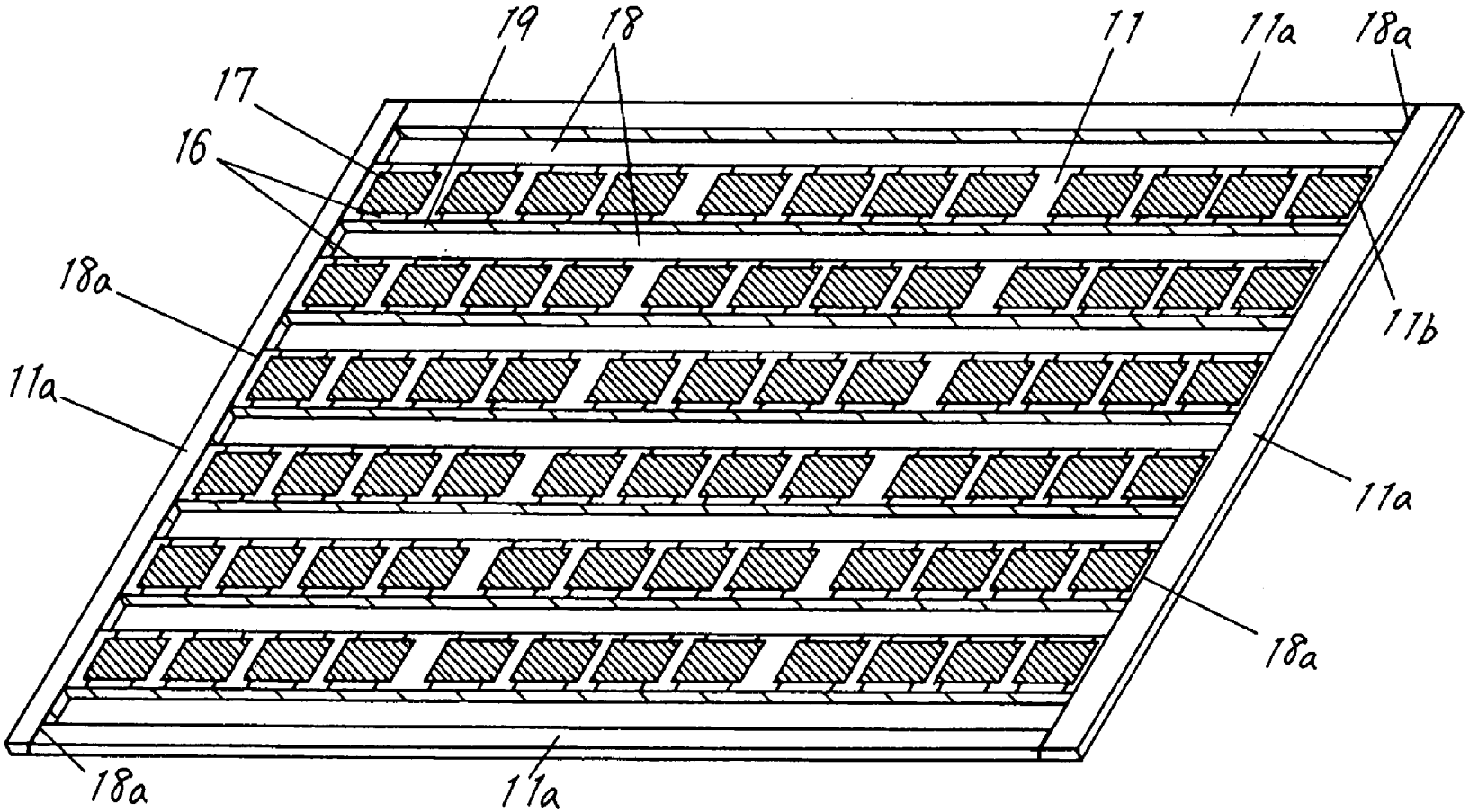
FIG. 16 is an upper perspective view of the substrate used in the method of Embodiment 1.
Figure 17:
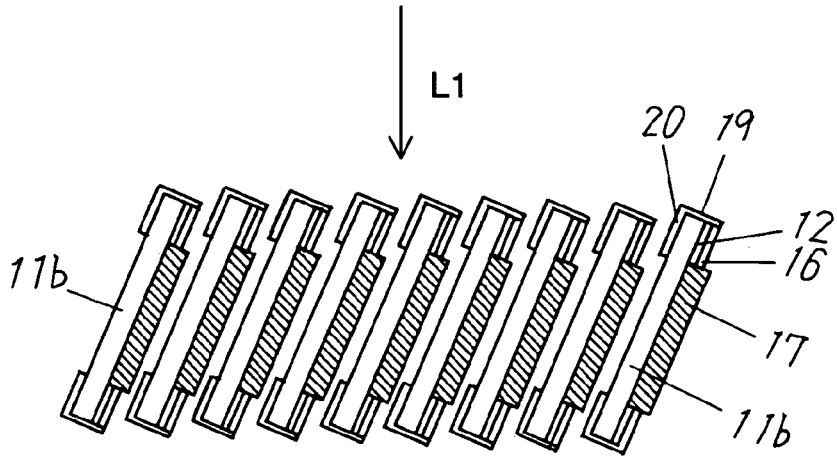
FIG. 17 is a side view of a rectangular strip substrate used in the method of Embodiment 1.
Figure 18:
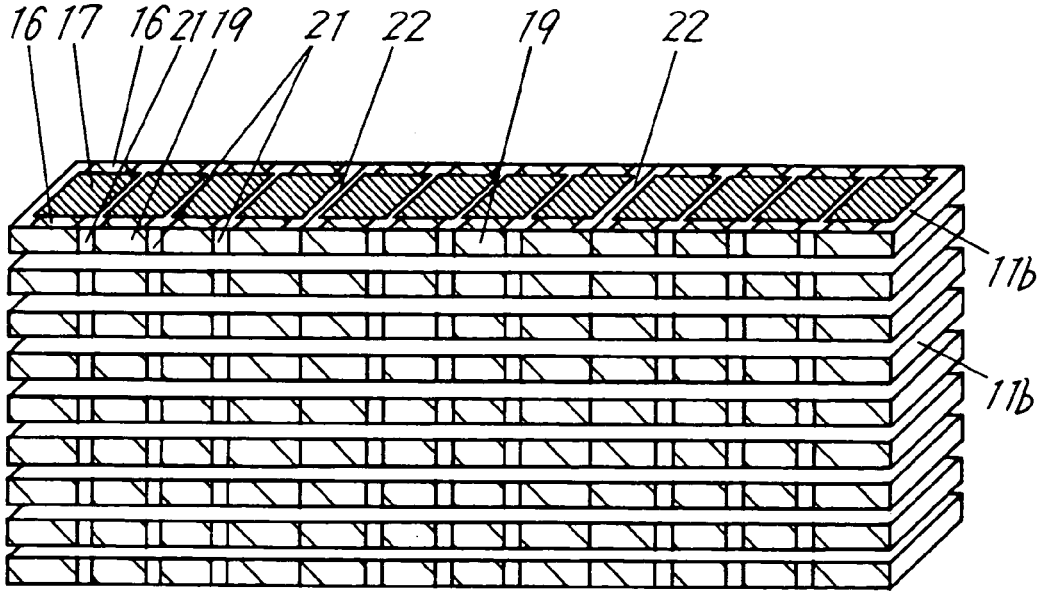
FIG. 18 is an upper perspective view of the strip substrate used in the method of Embodiment 1.
Figure 19:
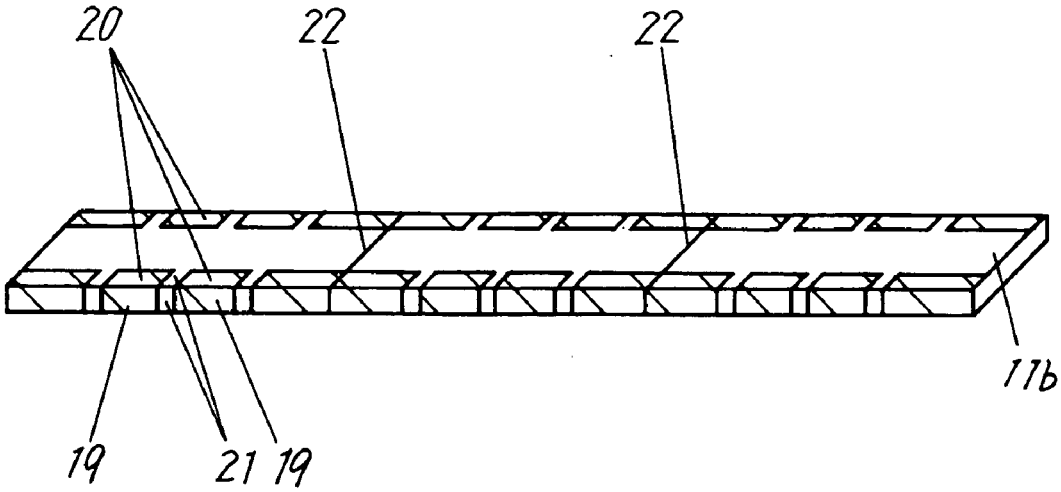
FIG. 19 is a lower perspective view of the strip substrate used in the method of Embodiment 1.
Figure 20:
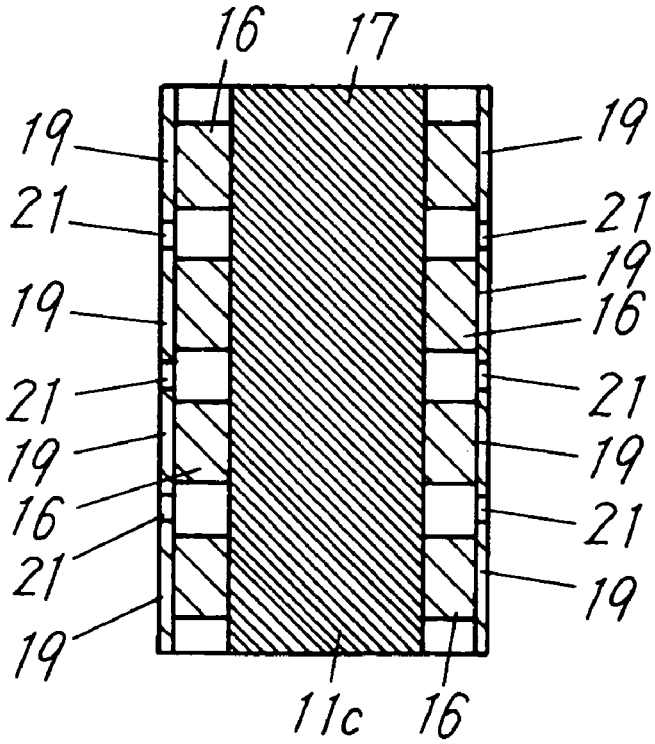
FIG. 20 is an upper view of the resistor for showing the method of manufacturing the resistor of Embodiment 1.
Figure 21:
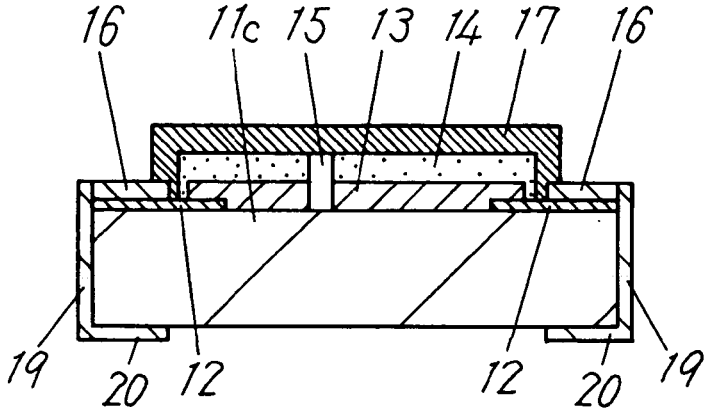
FIG. 21 is a cross sectional view of the resistor for showing the method of manufacturing the resistor of Embodiment 1.
Figure 22:
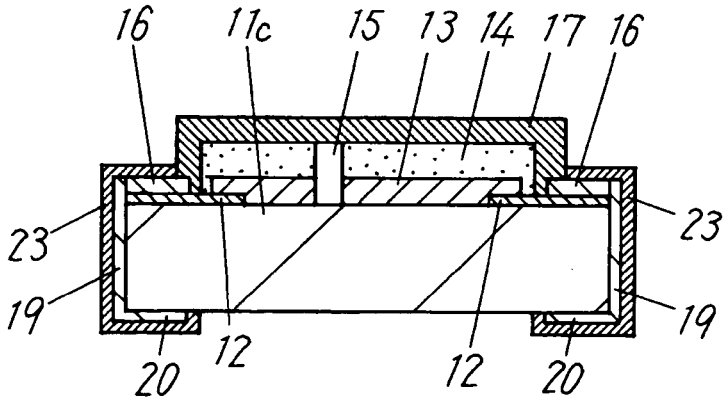
FIG. 22 is a cross sectional view of the resistor for showing the method of manufacturing the resistor of Embodiment 1.
Figure 23:
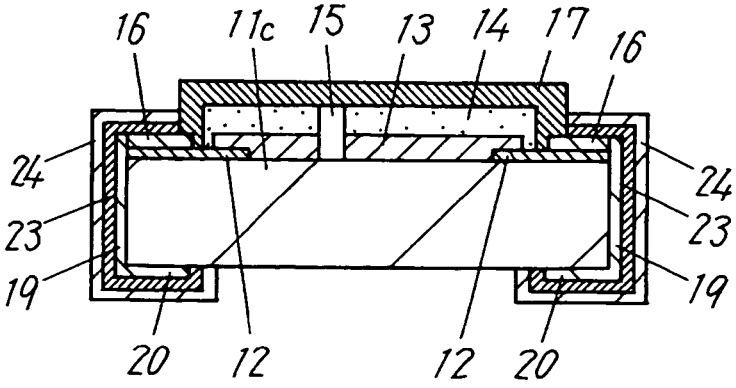
FIG. 23 is a cross sectional view of the resistor for showing the method of manufacturing the resistor of Embodiment 1.

FIG. 3 is an upper perspective view of a sheet substrate used in the method of manufacturing the multiple chip resistor of Embodiment 1. FIGS. 4A to 11B are cross sectional views and upper views of the resistor for showing the method of Embodiment 1. FIG. 12 is a perspective view of the lower surface of the substrate used in the method. FIG. 13 is a cross sectional view of the resistor for showing the method. FIG. 14 is a perspective view of the lower surface of the substrate for showing the method. FIG. 15 is a cross sectional view of the resistor for showing the method. FIG. 16 is a perspective view of the upper surface of the substrate used in the method. FIGS. 17 to 19 are side views and a perspective view of a strip substrate used in the method. FIG. 20 is an upper view of the resistor for showing the method. FIGS. 21 to 23 are cross sectional views of the resistor for showing the method.

Figure 4A:
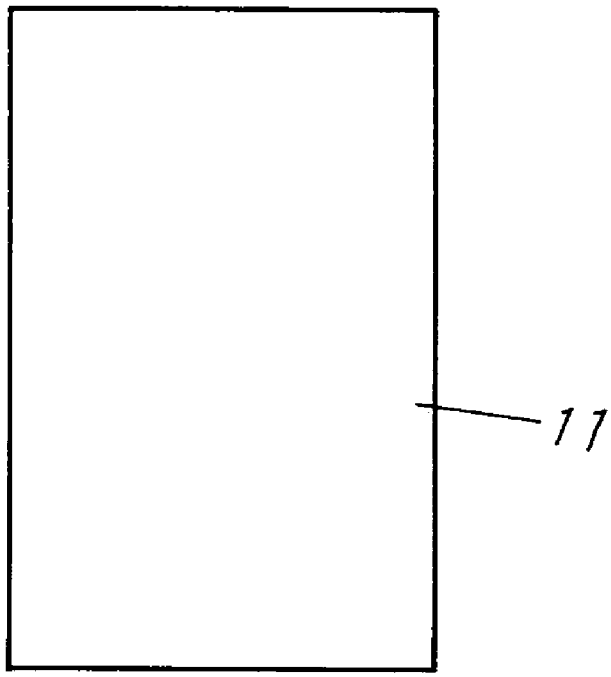
FIGS. 4A and 4B are upper views of the multiple resistor for showing the method of manufacturing the resistor of Embodiment 1.
Figure 5A:
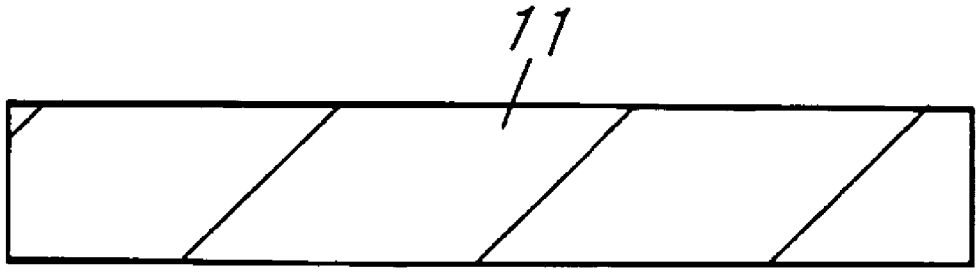
FIGS. 5A and 5B are cross sectional views of the resistor for showing the method of manufacturing the resistor of Embodiment 1.

As shown in FIGS. 3, 4A, and 5A, a sheet substrate 11 has a thickness of 0.2 mm and is made of electrically insulating material, such as baked aluminum of 96% purity. As shown in FIG. 3, the sheet substrate 11 has an unnecessary portion 11*a*, which is useless for the chip resistors, at a rim having substantially a four-sided frame form of the substrate 11.

Figure 4B:
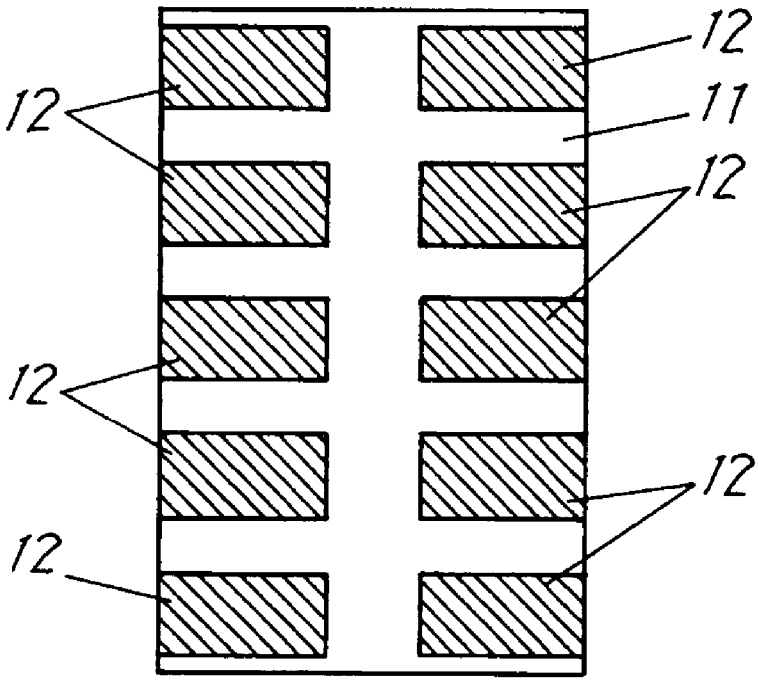
Figure 5B:
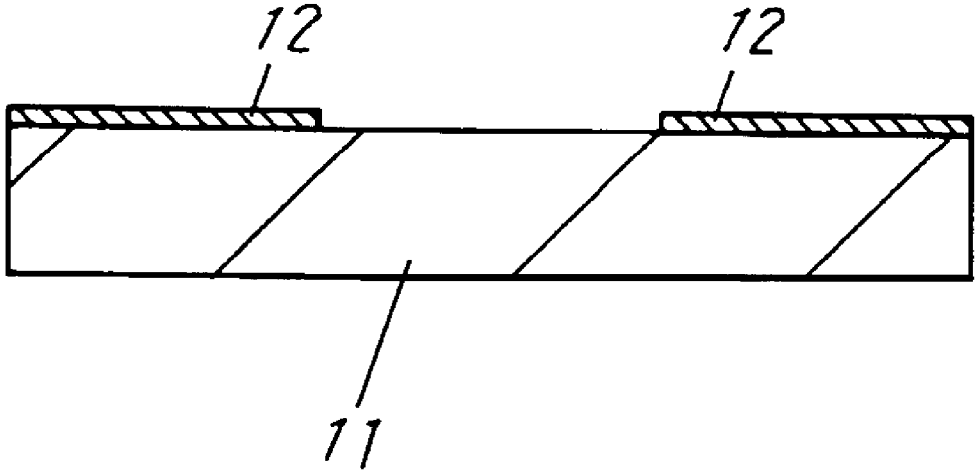

Then, as shown in FIGS. 3, 4B, and 5B, plural pairs of upper electrodes 12 of silver-based material are provided on the upper surface of the sheet substrate 11 by a screen printing technique. The upper electrodes 12 are baked at a baking profile with a peak temperature of 850° C.

Figure 6A:
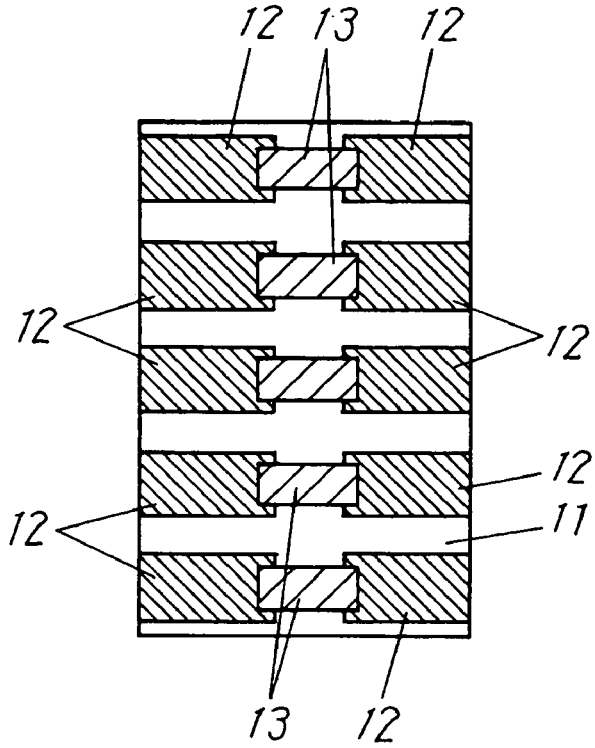
FIGS. 6A and 6B are upper views of the resistor for showing the method of manufacturing the resistor of Embodiment 1.
Figure 7A:
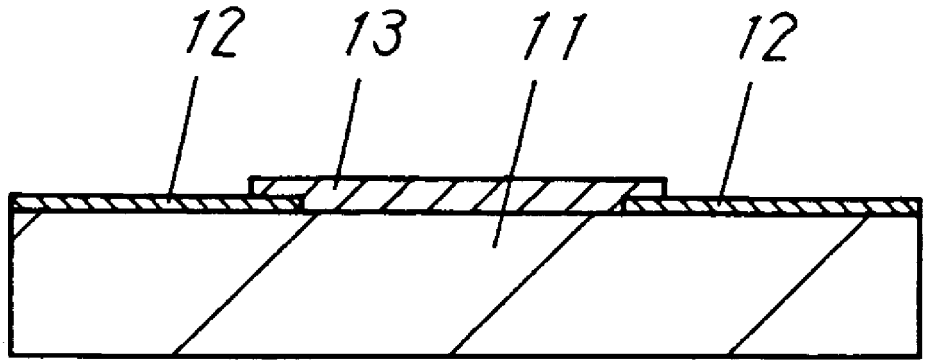
FIGS. 7A and 7B are cross sectional views of the resistor for showing the method of manufacturing the resistor of Embodiment 1.

As shown in FIGS. 3, 6A, and 7A, resistor elements 13 of ruthenium-oxide-based material are provided on the substrate 11 by a screen printing technique so that each resistor element bridges between the upper electrodes 12, and is then baked at a baking profile with a peak temperature of 850° C. for stabilization.

Figure 6B:
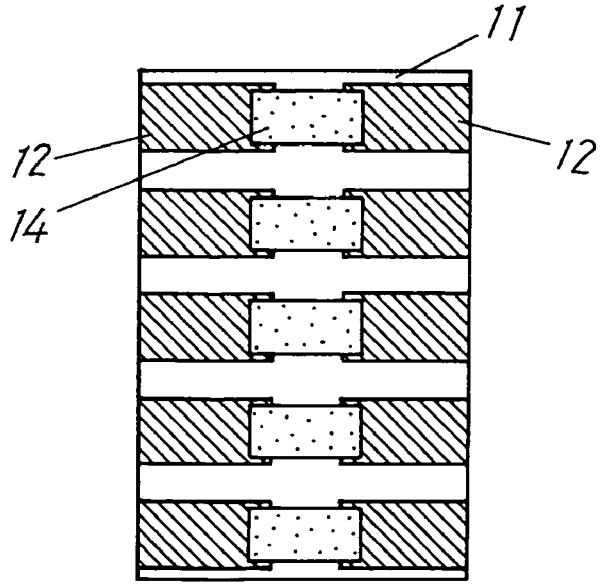
Figure 7B:
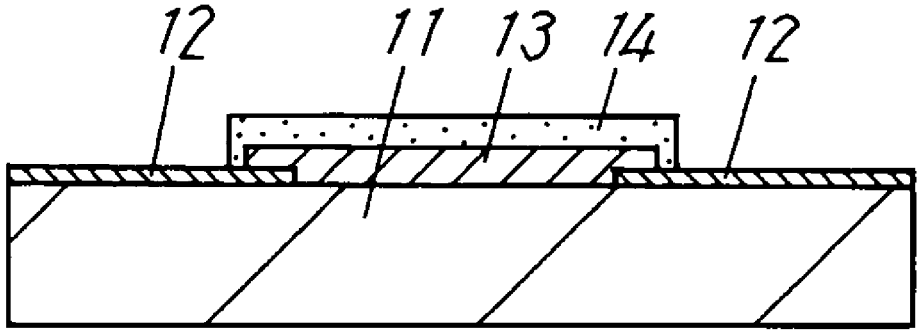

As shown in FIGS. 6B and 7B, first protective layers 14 of glass-based material are provided to cover respective resistor elements 13 by a screen printing technique and is then baked at a baking profile with a peak temperature of 600° C. for it to be stabilized.

Figure 8A:
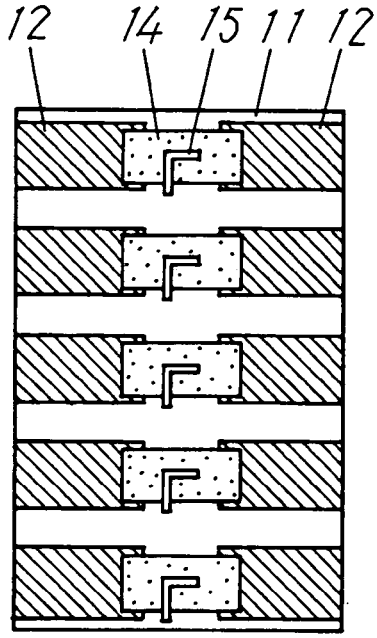
FIGS. 8A and 8B are upper views of the resistor for showing the method of manufacturing the resistor of Embodiment 1.
Figure 9A:
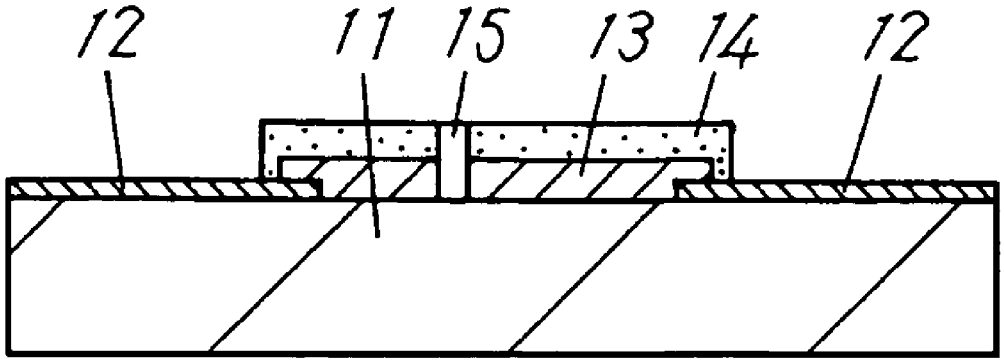
FIGS. 9A and 9B are cross sectional views of the resistor for showing the method of manufacturing the resistor of Embodiment 1.

As shown in FIGS. 8A and 9A, a trimming trench 15 is provided in each of the resistor elements 13 between the upper electrode layers 12 by a laser trimming technique for adjusting the resistance of the resistor element 13 into a predetermined resistance.

Figure 8B:
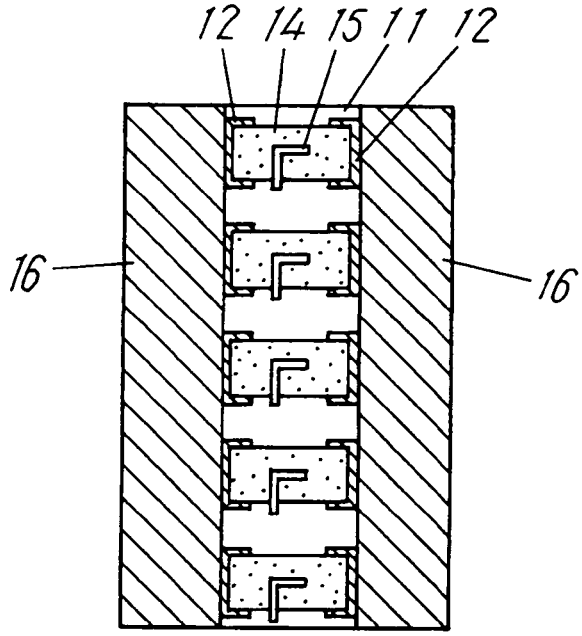
Figure 9B:
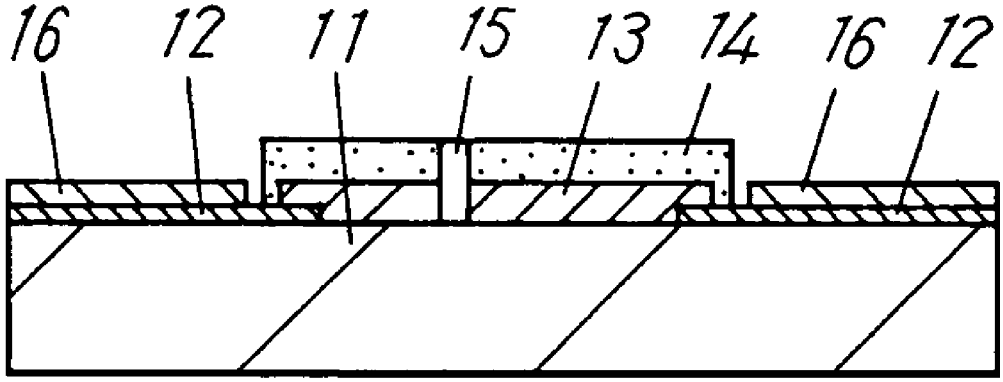

As shown in FIGS. 8B and 9B, plural pairs of adhesive layers 16 of silver-based conductive resin material are provided by a screen printing technique to partially overlap the upper electrode layers 12 and are then cured at a curing profile with a peak temperature of 200° C. to be stabilized.

Figure 10A:
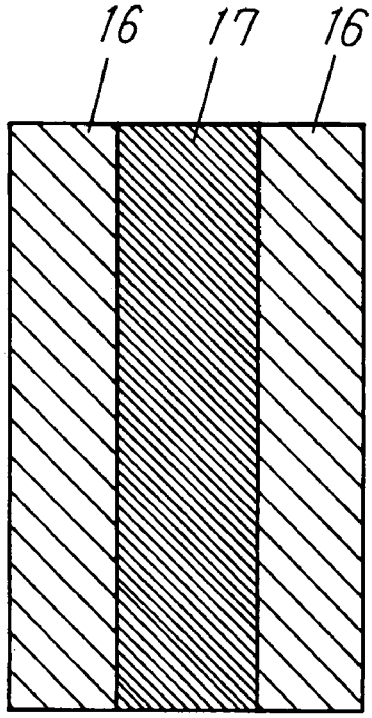
FIGS. 10A and 10B are upper views of the resistor for showing the method of manufacturing the resistor of Embodiment 1.
Figure 10B:
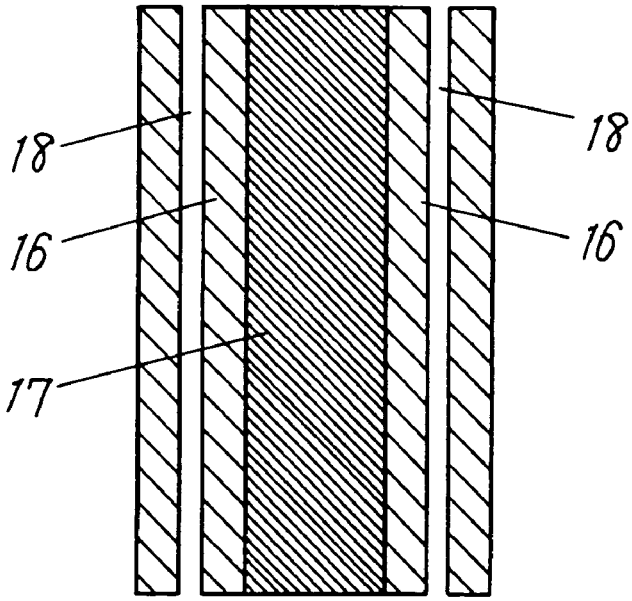
Figure 11A:
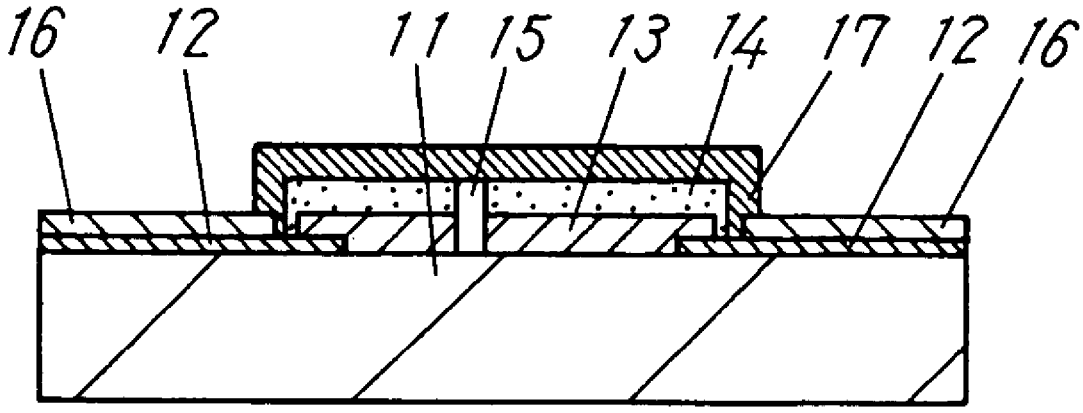
FIGS. 11A and 11B are cross sectional views of the resistor for showing the method of manufacturing the resistor of Embodiment 1.
Figure 11B:
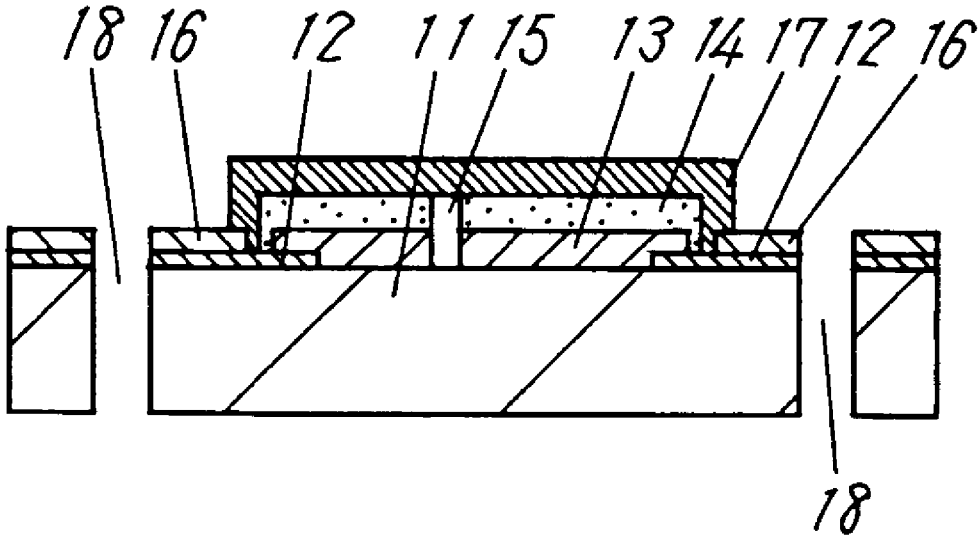

As shown in FIGS. 10A and 11A, a second protective layer 17 of resin-based material is provided to entirely cover the first protective layer 14 arranged in a vertical direction in the figures, and partially overlaps the adhesive layers 16 by a screen printing technique. The second protective layer 14 is then cured at a curing profile with a peak temperature of 200° C. to be stabilized As shown in FIGS. 3, 10B, and 11B, slits 18 are provided by dicing the substrate along the second protective layers 17 except the unnecessary portion 11*a* at the rim of the substrate 11. The slits 18 serve as the first dividing sections for dividing the upper electrode layers 12 and the adhesive layers 16 in order to divide the substrate 11 into rectangular strip substrates 11*b*. The unnecessary portion 11*a* is not provided with the slits 18 upon dicing of the substrate 11, and is thus connected to the strip substrates 11*b*, thus permitting the sheet substrate 11 to maintain its sheet form.

As shown in FIGS. 12 and 13, edge electrode 19 of a nickel-chrome thin film having a large bonding strength to the substrate 11 is deposited by a thin film technique, such as sputtering. The edge electrode 19 is provided on the low surface of the substrate 11, side surfaces of the upper electrode layers 12, and the adhesive layer 16 at the slits 18.

As shown in FIGS. 14 and 15, the edge electrode 19 deposited over the lower surface of the sheet substrate 11 includes an unnecessary portion having a width of about 0.3 mm substantially at the center of the strip substrate. The unnecessary portion of the edge electrode 19 is evaporated to be removed by a laser beam having a spot diameter of about 0.3 mm. This process provides back electrodes 20 along the slits 18 as exposed portions of the edge electrodes 19 on the lower surface of the sheet substrate 11.

As shown in FIG. 16, the sheet substrate 11 having the slits 18 provided therein by dicing in the lengthwise direction of the substrate is placed on an unnecessary-portion-cut-off pallet (not shown) to be cut along lines 18*a* extending through respective edges of the slits 18. Upon having the unnecessary portion 11*a* cut off, the substrate 11 is divided into the strip substrates 11*b*.

As shown in FIG. 17, the strip substrates 11*b* are aligned to be tilted while the edge electrodes 19 is directed towards the top and bottom and the second protective layers 17 face down. The edge electrode 19 is formed at one edge of the strip substrate 11*b*, and the back electrode 20 is provided on a portion of the lower surface of the strip substrate 11*b* adjoining the one edge of the strip substrate 11*b*. A laser L1 is then applied from the side opposite to the second protective layers 17 for removing respective portions of the edge electrode 19 and the back electrode 20 between the resistor elements 13 adjacent to each other. In particular, the laser L1 is directed not parallel to the upper surface of the strip substrate 11*b*. As the result, the resistor elements 13 adjacent to each other are electrically isolated from each other. Then, a portion of the other edge of the edge electrode 19 and a portion of the back electrode 20 between the resistor elements 13 adjacent to each other are removed by laser irradiated from the other side. The back electrode 20 is provided on a portion of the lower surface of the strip substrate 11*b* adjoining the other edge of the strip substrate 11*b*.

Accordingly, as shown in FIGS. 18 and 19, gaps 21 in the edge electrodes 19 and the back electrodes 20 are provided between the resistor elements 13 adjacent to each other on each strip substrate 11*b*. The resistor elements 13 are physically separated by the gaps 21 provided in the edge electrodes 19 and the back electrodes 20, thus electrically isolated from each other.

Then, the strip substrate 11*b*, as shown in FIGS. 18 and 19, is divided along the slits 22, i.e., the second dividing sections into chip substrates 11*c* includes four of the resistor elements 13 shown in FIGS. 20 and 21.

The second dividing sections 22 are provided by a laser scribing technique. After the scores are provided by irradiation of laser, the strip substrate 11*b* is divided into the chip substrates 11*c* by general dividing equipment. More particularly, the strip substrate 11*b* is divided not every time when the dividing section 22 is formed but in two steps. Alternatively, the second dividing sections 22 may be provided by a dicing technique. The dicing divides the strip substrate 11*b* into the chip substrates 11*c* every time when the second dividing sections 22 are provided.

Then, as shown in FIG. 22, the edge electrodes 19, the adhesive layers 16, and the back electrodes 20 of each chip substrate 11*c* are covered with a first plating layer 23 having substantially a thickness ranging from 2 to 6 μm of nickel which is favorable in protection from soldering diffusion and in a heat resistance by an electric plating technique. As shown in FIG. 23, a second plating layer 24 having substantially a thickness ranging from 3 to 8 μm of tin which is favorable in soldering affinity is provided to cover the first plating layer 23. The method of Embodiment 1 described above provides the multiple chip resistor.

In the method of Embodiment 1, the second plating layer 24 is made of tin. The layer, however, is not limited to the tin, and may be made of tin alloy material. This material enables the resistor to be soldered stably by reflow-soldering.

In the method, the resistor elements 13 are protected with two layers, i.e., the first protective layer 14 of glass-based material covering the resistor element 13 and the second protective layer 17 of resin-based material covering the first protective layer 14 and the trimming trench 15. The first protective layer 14 prevents the element from cracks generated during the laser trimming process, thus reducing a current noise. The second protective layer 17 of the resin-based material encloses the resistor element 13 to provide a large moisture resistance.

In the method, the upper electrodes 12 and the adhesive layers 16 are flush at outer edge with each other along the inner wall at each slit 18 provided in the sheet substrate 11. This arrangement allows the edge electrode 19 to be developed continuously and consistently on one edge of the sheet substrate 11, one edge of the upper electrode 12, and one edge of the adhesive layer 16 on the slit 18 by a thin film technique.

In the method, the adhesive layer 16 of electrically conductive resin material overlaps partially the upper electrode 12. The adhesive layer 16 allows the edge electrode 19 of a thin film formed on the slit 18 to have a large area contacting the upper electrode 12, thus improving an electrical conduction between the edge electrode 19 and the upper electrode 12.

In the method, the edge electrode 19 is a nickel-chrome thin film deposited by sputtering. The edge electrode 19 is not limited to the nickel-chrome thin film but may includes plural layers of chrome material, copper material, and nickel material. The materials allow the edge electrode 19 to have an affinity with a plating layer, thus providing the plating layer with a large bonding strength.

In the multiple chip resistor manufactured by the method, an interval between the slits 18, i.e., the first dividing sections formed by the dicing is accurate, and an interval between the second dividing sections 22 provided by the laser scribing is accurate (within ±0.005 mm). The edge electrode 19, the first plating layer 23, and the second plating layer 24 have accurate thicknesses. Accordingly, the multiple chip resistor has a length of 0.6 mm and a width of 1.2 mm accurately. The accuracy allows no dimensional classification of each chip substrate due to a patterning accuracy of the upper electrode layers 12 and the resistor element 13 to be needed while dimensional deviation of chip substrates classified as one level is not needed to consider. As the result, an effective area of the resistor elements 13 can be greater than that of a conventional multiple chip resistor. More specifically, the resistor element 13 according to Embodiment 1 has a length of 0.25 mm and a width of 0.24 mm, thus having an area larger than 1.6 times of an area of a resistor element of a conventional resistor having a length of 0.20 mm and a width of 0.19 mm.

In the method, the slits 18 serving as the first dividing sections provided by the dicing allows the sheet substrate 11 not to need the dimensional classification of the chips. As no dimensional classification of the chips are needed unlike the conventional method, the steps of the manufacturing can be facilitated hence permitting the sheet substrate 11 to be divided easily with common dicing equipment used widely in semiconductor industries.

In the method, the sheet substrate 11 has the slits 18 provided therein for isolating the upper electrode layers 12 from each other and utilized for dividing the sheet substrate 11 into the chip substrates 11*c* each of which includes a predetermined number of the resistor elements 13. As no dimensional classification of the chips is needed unlike the conventional method, that is, as a process of changing masks corresponding to various levels of dimensional classification is not necessary, the chip resistor is manufactured by simple processes.

In the method, the edge electrodes 19 are provided by a thin film technique, such as sputtering, on the lower surface of the sheet substrate 11. Then, the unnecessary portions having a width of about 0.3 mm substantially at the center of the lower surface of the sheet substrate 11 except portions of the back electrode adjoining the slits 18 are evaporated and removed by laser beam having a spot diameter of about 0.3 mm irradiated to the unnecessary portions. As the result, the back electrodes 20 adjoining the slits 18 are formed on the lower surface of the sheet substrate 11, hence functioning as portions of the edge electrodes 19. This arrangement allows the back electrodes 20 functioning as the portions of the edge electrodes 19 to be formed dimensionally accurately, thus allowing the interval between the back electrodes 20 to be accurate throughout the lower surface of the sheet substrate 11. This prevents the multiple chip resistor from being mounted defectively when the resistor is surface-mounted.

In the method, the second protective layers 17 are made of resin material. The edge electrodes 19 and the back electrodes 20 are provided by a thin film deposition technique from the back side of the sheet substrate 11 on edge portions adjoining the slits 18 of the lower surface of the sheet substrate 11, both edges of the sheet substrate 11, one edge of the upper electrode layers 12, and one edge of the adhesive layers 16 at the slits 18 which extend through the sheet substrate 11 for isolating the upper electrode layers 12 from each other. The sheet substrate 11 is then divided into the strip substrates 11*b* by cutting the substrate through the edges of the slits 18. Then, the unnecessary portions of the edge electrodes 19 and the back electrodes 20 are removed from the strip substrates 11*b* by laser irradiating from both the side corresponding to the second protective layer 17 of resin and the side opposite to the side corresponding to the layer 17 for electrically isolating the resistor elements 13 adjacent to each other from each other. During the irradiation of laser, the strip substrates 11*b* are held while being tilted, that is, while being positioned at an angle to the laser. The position thus protects the second protective layers 17 of resin from the laser while the unnecessary portions of the edge electrodes 19 and the back electrodes 20 are removed from the lower surface of the sheet substrate 11 by the laser. As a result, the edge electrodes 19 adjacent to each other can be securely isolated from each other while the back electrodes 20 adjacent to each other are securely isolated from each other.

According to Embodiment 1, the strip substrates 11*b* are tilted so that the second protective layers 17 face down and are exposed to the laser at the side opposite to the second protective layers 17. Alternatively, each of the strip substrates 11*b* may be tilted one by one so that with the second protective layers 17 face down and are exposed to the laser at the side opposite to the second protective layers 17 for removing the unnecessary portions of the edge electrodes 19 and the back electrodes 20 to isolate the resistor elements 13 adjacent to each other from each other. This method protects the second protective layers 17 from being exposed to the laser, as explained in Embodiment 1. Moreover, the edge electrodes 19 adjacent to each other can be securely isolated from each other while the back electrodes 20 adjacent to each other are securely isolated from each other.

According to Embodiment 1, the strip substrates 11*b* having the edge electrodes 19 and the back electrodes 20 are arranged in a horizontal direction and tilted so that the second protective layers 17 face down. Alternatively, if the second protective layers 17 are not made of resin material, the strip substrates 11*b* may be held longitudinally upright. The strip substrates 11*b* are not limited to be aligned along the horizontal direction but may be processed one by one.

According to Embodiment 1, the strip substrates 11*b* having the edge electrodes 19 and the back electrodes 20 are arranged in a horizontal direction and tilted so that the second protective layers 17 face down. This arrangement has the strip substrates 11*b* positioned at an angle so as to be non-parallel to the laser, thus facilitating the removal of the unnecessary portions of the edge electrodes 19 and the back electrodes 20 from the side opposite to the second protective layers 17 to isolate the resistor elements 13 from each other. Alternatively, as shown in FIG. 18, the strip substrates 11*b* having the edge electrodes 19 and the back electrodes 20 may be stacked in a vertical direction. Further, the strip substrates may be arranged in a horizontal direction one by one, may stand upright, or may be held upright one by one before the removal of the unnecessary portions of the edge electrodes 19 and the back electrodes 20 by the laser for electrically isolating the resistor elements 13 from each other. In any case, since the unnecessary portions are removed from the side and lower surfaces of the substrate 11*b* by the laser, the edge electrodes 19 and the back electrodes 20 can be securely isolated from each other. This prevents the multiple chip resistor from being mounted defectively when the resistor is surface-mounted.

According to Embodiment 1, the strip substrates 11*b* having the edge electrodes 19 and the back electrodes 20 are tilted so that the second protective layers 17 face down, thus being held at an angle against the irradiated laser and non-parallel to the laser. Alternatively, the laser may be irradiated at an angle to the lower surface of the strip substrates 11*b*. This ensures effects equal to that of Embodiment 1.

The multiple chip resistor manufactured by the method of Embodiment 1 is not limited to include four of the resistor elements as described above but may include plural resistor elements by modifying locations of the second dividing portions 22 provided by laser scribing.

According to Embodiment 1, the electrodes are provided on both edges of the strip substrate 11*b*, but may be provided at one edge of the substrate with equal effects.

Embodiment 2

A method of manufacturing a multiple chip resistor according to Exemplary Embodiment 2 of the present invention will be described by referring to relevant figures. The method of Embodiment 2 is differentiated from that of Embodiment 1 by some processes which are explained in detail while the description of other identical processes is omitted. More particularly, the method of Embodiment 2 is identical to that of Embodiment 1 before a process of providing back electrodes 20 shown in FIGS. 14 and 15. Processes after the process will be described while like components are denoted by like numerals as those of Embodiment 1.

Figure 24:
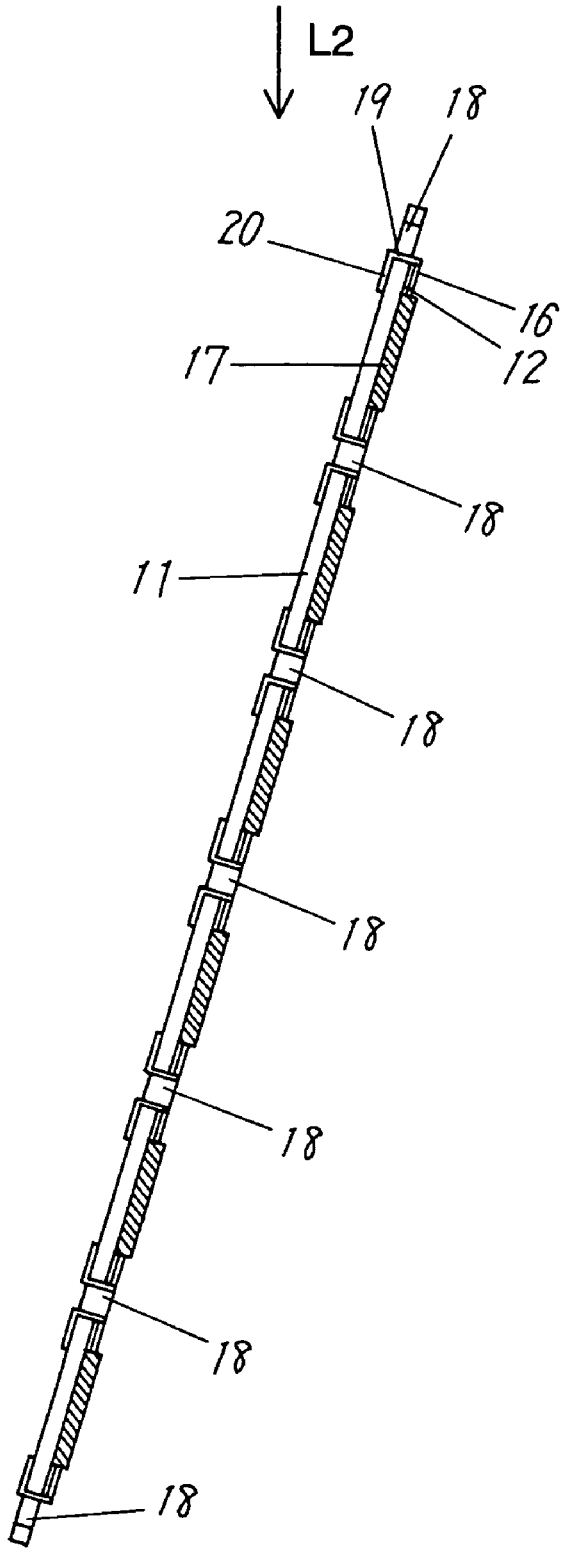
FIG. 24 is a side view of a sheet substrate for multiple chip resistors manufactured by a method according to Exemplary Embodiment 2 of the invention.
Figure 25:
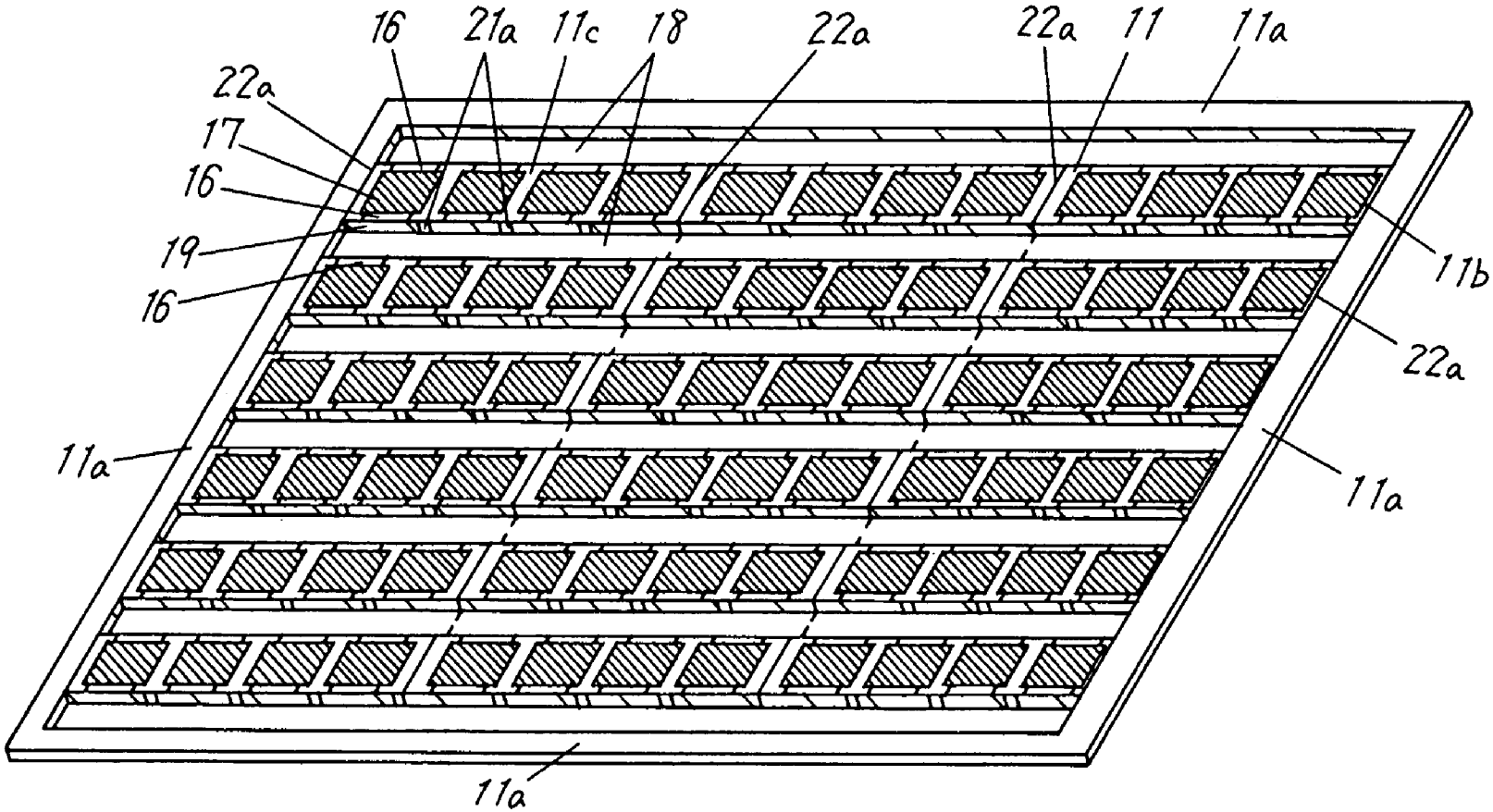
FIG. 25 is an upper perspective view of the substrate used in the method of Embodiment 2.
Figure 26:
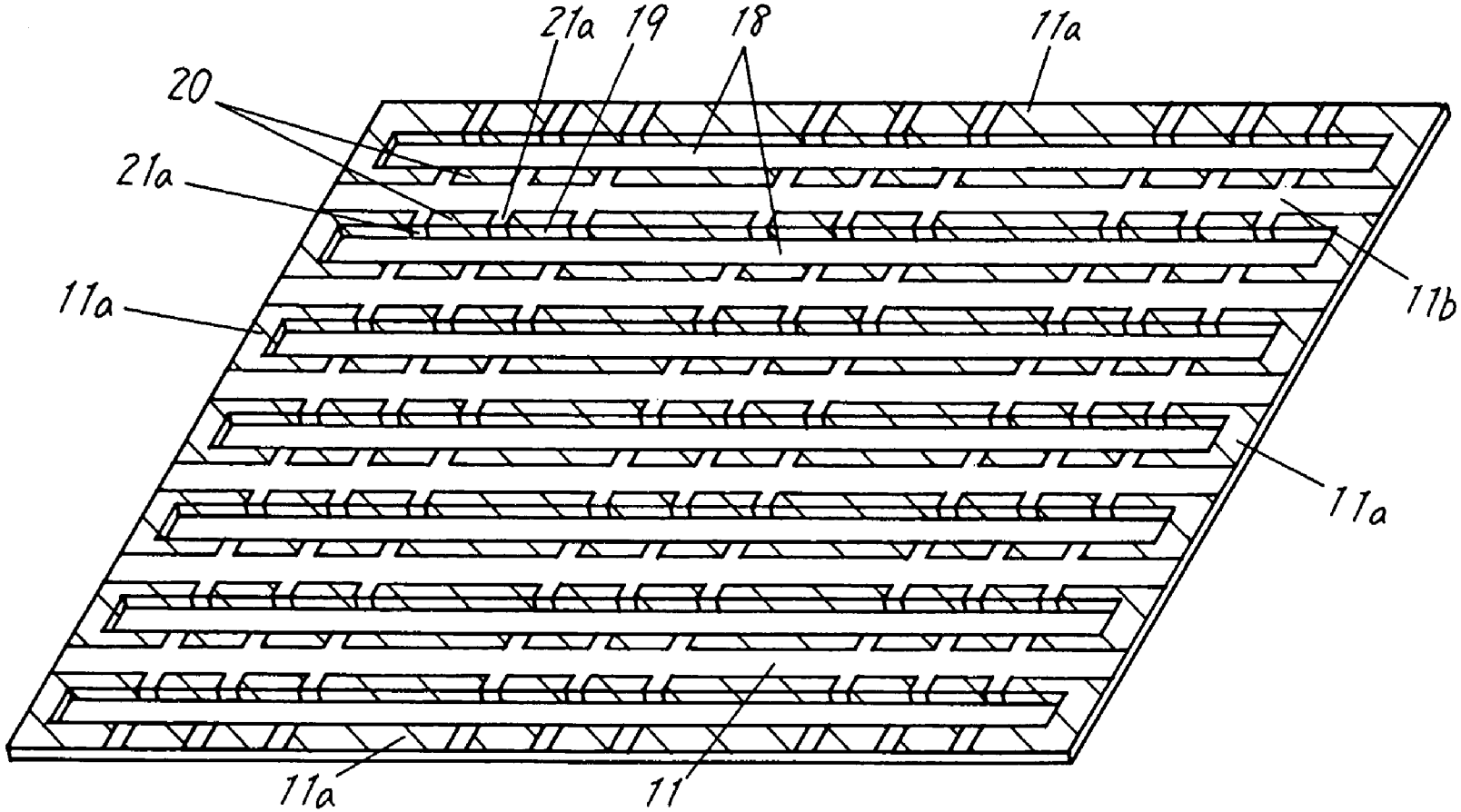
FIG. 26 is a lower perspective view of the substrate used in the method of Embodiment 2.

After being provided with the back electrodes 20 shown in FIGS. 14 and 15, the sheet substrate 11 having second protective layers 17, edge electrodes 19, and the back electrodes 20 are tiled so that the second protective layers 17 face down, as shown in FIG. 24. The edge electrodes and the back electrodes 20 include unnecessary portions between resistor elements 13 adjacent to each other (not shown). Laser L2 non parallel to the upper surface of the sheet substrate 11 is irradiated from a side opposite to the second protective layers 17 to remove the unnecessary portions of the edge electrodes 19 and the back electrodes 20 from side surfaces of the slits 18. One edge of the upper electrodes 12, one edge of the adhesive layers 19, and the lower surface of the sheet substrate 11 adjoining the slits 18 for isolating the resistor elements 13 from each other. The laser L2 is radiated repetitively from the opposite side for removing the unnecessary portions of the edge electrodes 19 and the back electrodes 20 at the other side between the resistor elements 13 (not shown). Then as shown in FIGS. 25 and 26, gaps 21*a* are provided between the resistor elements 13 (not shown) in the edge electrodes 19 and the back electrodes 20. The resistor elements (not shown) are physically separated by the gaps 21*a* provided in the edge electrodes 19 and the back electrodes 20. In other words, the resistor elements (not shown) are electrically isolated from each other.

Figure 27:
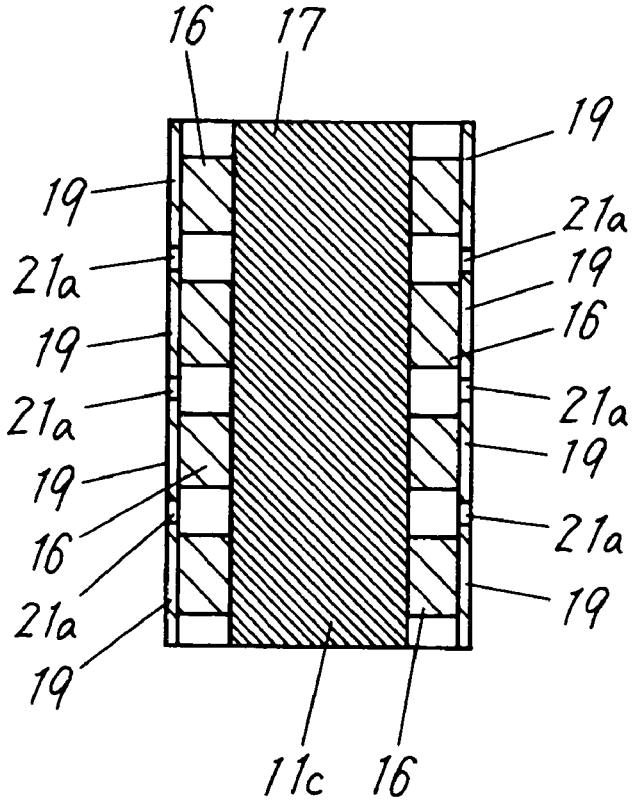
FIG. 27 is an upper view of the resistor for showing of the method of manufacturing the resistor of Embodiment 2.
Figure 28:
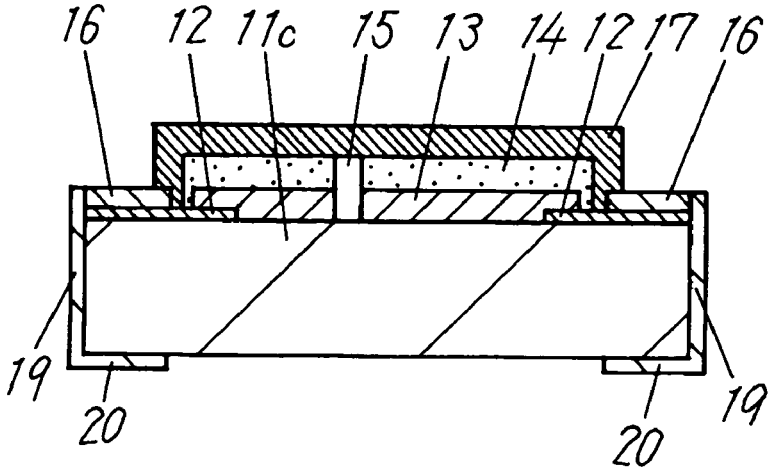
FIG. 28 is a cross sectional view of the resistor for showing the method of manufacturing the resistor of Embodiment 2.

Then, as shown in FIG. 25, second dividing sections 2*a* are provided in the sheet substrate 11 perpendicularly to slits 18, i.e., first dividing sections, except unnecessary portion 11*a* at a rim of the sheet substrate 11. The sections allow the sheet substrate 11 to be divided into rectangular strip substrates 11*b*. The strip substrate 11*b* is then divided into chip substrates 11*c* each of which includes four of the resistor elements 13, as shown in FIGS. 27 and 28.

The second dividing sections 22*a* may be provided by a laser scribing technique similarly to that of Embodiment 1.

Figure 29:
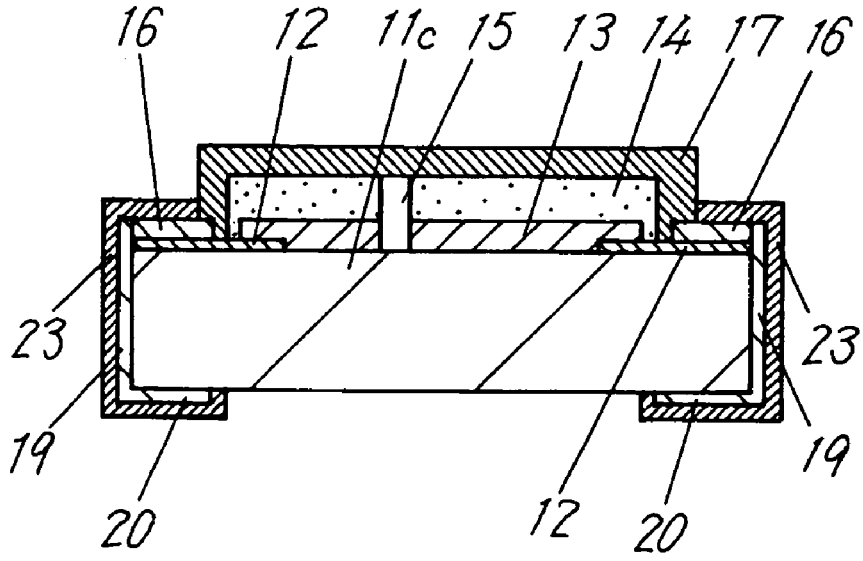
FIG. 29 is a cross sectional view of the resistor for showing the method of manufacturing the resistor of Embodiment 2.
Figure 30:
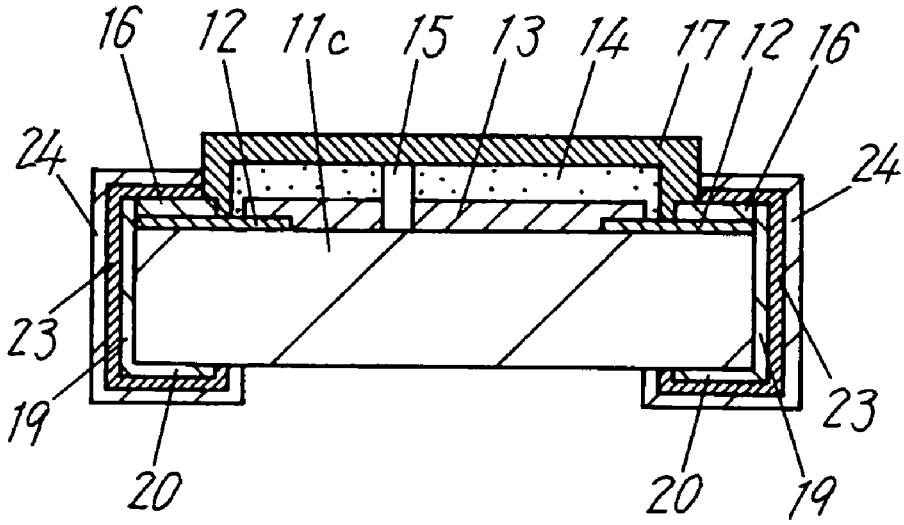
FIG. 30 is a cross sectional view of the resistor for showing the method of manufacturing the resistor of Embodiment 2.
Figure 31:
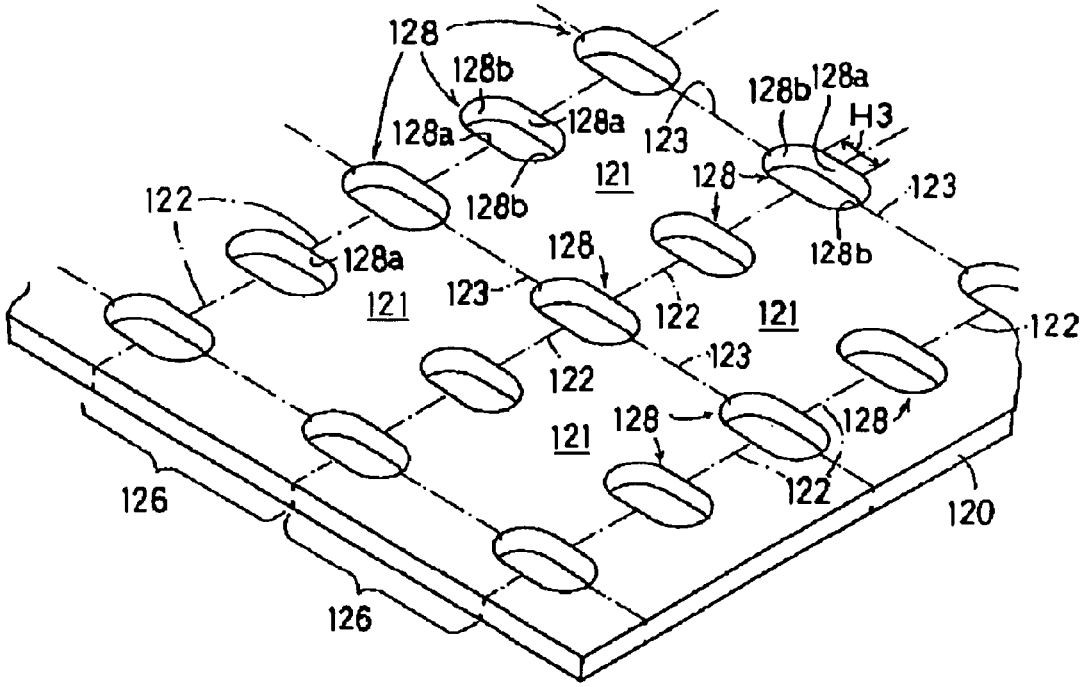
FIG. 31 PRIOR ART
FIG. 31 is a perspective view of a conventional multiple chip resistor for showing a conventional method of manufacturing the conventional resistor.
Figure 32:
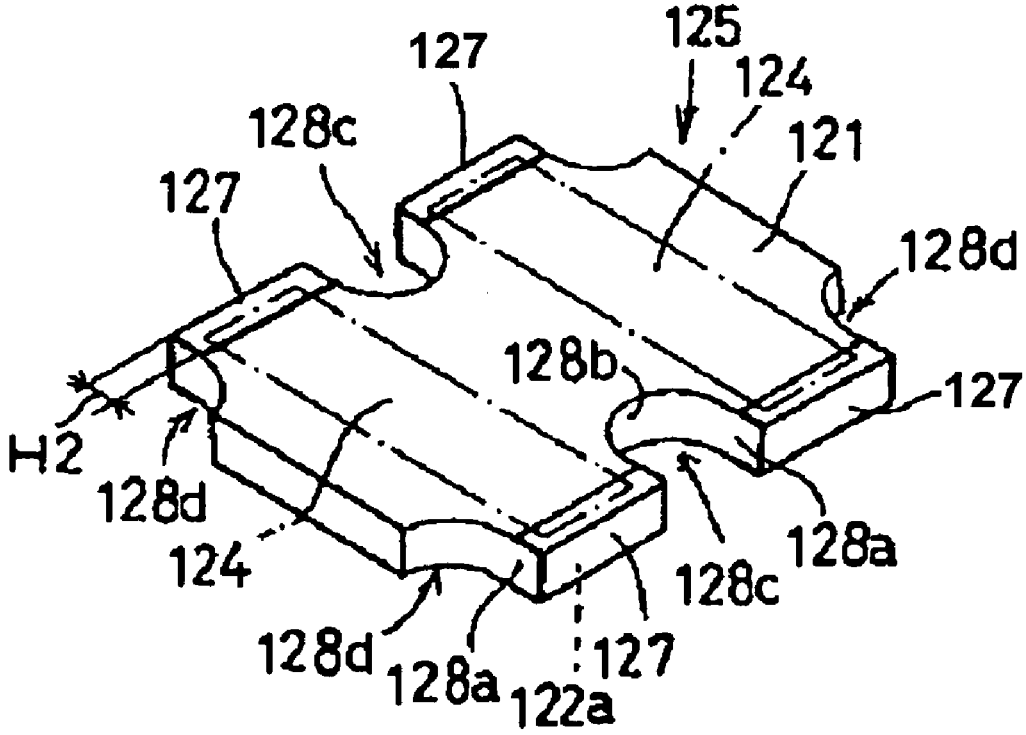
FIG. 32 PRIOR ART
FIG. 32 is a perspective view of the multiple chip resistor manufactured by the conventional method.
Figure 33:
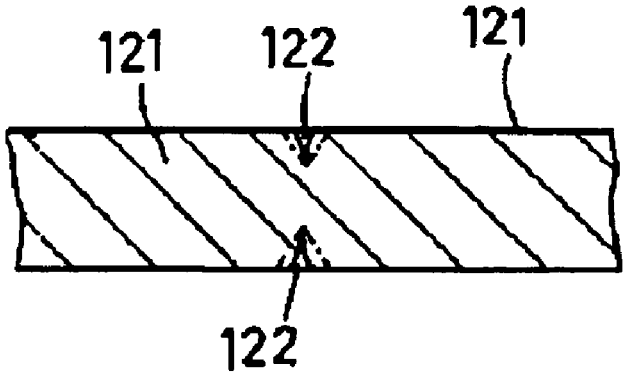
FIG. 33 PRIOR ART
FIG. 33 is a cross sectional view of the conventional resistor for showing the conventional method.

As shown in FIG. 29, the edge electrodes 19, the adhesive layers 16, and the back electrodes 20 of each chip substrate 11*c* are then covered with a first plating layer 23 having substantially a thickness ranging from 2 to 6 μm of nickel, which is favorable in soldering diffusion protection and has a heat resistance. The plating layer is provided by electric plating technique. As shown in FIG. 30, a second plating layer 24 having substantially a thickness ranging from 3 to 8 μm of tin, which is favorable in soldering affinity is provided by an electric plating technique to cover the first plating layer 23 of nickel. The foregoing processes provides the multiple chip resistor according to Embodiment 2.

In the method of Embodiment 2, the sheet substrate 11 having the edge electrodes 19 and the back electrodes 20 provided therein and the slits 18 provided therein for isolating the upper electrode layers 12 is tilted so that the second protective layers 17 of resin material face down. Since having the upper surface of the substrate be non-parallel to the irradiated laser, the sheet substrate 11 is exposed to the laser at the side opposite to the side corresponding to the second protective layers 17 for removing the unnecessary portions of the edge electrodes 19 and the back electrodes 20 to isolate the resistor elements adjacent to each other (not shown) from each other. This figure protects the second protective layers 17 from being exposed to the laser while facilitating the removal of the unnecessary portions at the slits 18 of the edge electrodes 19 and the unnecessary portions of the back electrodes 20 adjoining the slits 18 simultaneously by the irradiated laser. Then, the edge electrodes 19 can be securely isolated from each other while the back electrodes 20 extending from the edge electrodes 19 are securely isolated from each other.

According to Embodiment 2, the sheet substrate 11 having the edge electrodes 19 and the back electrodes 20 is tilted so that the second protective layers 17 face down. Alternatively, the sheet substrate 11 may be not tilted but held upright for removing the unnecessary portions of the edge electrodes 19 and the back electrodes 20 by the irradiated laser. This improves the dimensional accuracy of the edge electrodes 19 and the back electrodes 20 extending from the edge electrodes 19 on the chip substrate 11*c*. The edge electrodes 19 can be securely isolated from each other while the back electrodes 20 extending from the edge electrodes 19 can be securely isolated from each other. This prevents the multiple chip resistor from being mounted defectively when the resistor is surface-mounted.

According to Embodiment 2, the sheet substrate 11 is tilted so that the second protective layers 17 face down, and the substrates 11 are thus non-parallel with the irradiated laser. Alternatively, the laser may be irradiated at an angle in parallel to the lower surface of the sheet substrate 11. This provides effects equal to that of Embodiment 2.

The method of manufacturing multiple chip resistors of Embodiment 2 before a process of providing the back electrodes 20 is identical to that of Embodiment 1 shown in FIGS. 14 and 15, thus having effects equal to that of Embodiment 1.

According to Embodiment 2, the electrodes are provided on both edges of the strip substrate 11*b*. However, a technique of Embodiment 2 is applicable to electrodes provided at one edge of the substrate with the same effects.

INDUSTRIAL APPLICATION

In a method of manufacturing a multiple chip resistor according to the present invention, edge electrodes on each strip substrate have an improved dimensional accuracy, thus being isolated electrically from each other. Consequently, the multiple chip resistor is prevented from being mounted defectively when the resistor is surface-mounted.

The invention claimed is:

1. A method of manufacturing a multiple chip resistor, comprising the steps of:

forming first electrode layers on a first surface of a substrate;

forming resistor elements in a plane which is situated on the first surface of the substrate, the resistor elements being electrically connected to the first electrode layers, respectively;

forming slits in the substrate for separating the first electrode layers;

forming edge electrodes on respective edges at the slits of the substrate, each of the edge electrodes being connected to the first electrode layers at the edges of the slits, respectively;

dividing the substrate at the slits into strip substrates;

removing portions of the edge electrodes for electrically isolating the resistor elements from each other and for forming gaps between remaining portions of the edge electrodes without removing a portion of the substrate; and dividing each of the strip substrates into chip substrates, each of the chip substrates having at least two resistor elements in a respective portion of said plane, the plane remaining on said chip substrates after said chip substrates are formed, while maintaining the gaps between the remaining portions of the edge electrodes.

2. The method according to claim 1, further comprising the step of forming second electrode layers on a second surface of the substrate adjoining the slits, the second electrode layers being connected to the edge electrodes, respectively.

3. The method according to claim 2, further comprising the step of removing portions of the second electrode layers connected to the portions of the edge electrodes, respectively.

4. The method according to claim 2, wherein said step of removing the portions of the edge electrodes includes removing the portions by laser.

5. The method according to claim 4, further comprising the step of forming a protective layer covering at least one of the resistor elements, wherein said step of removing the portions of the edge electrodes comprises laser-irradiating toward the portions from a side corresponding to the second surface of the substrate, the laser-irradiating being non-parallel to the second surface of the substrate.

6. The method according to claim 5, further comprising the steps of:

forming second electrode layers on portions of the second surface of the substrate adjoining the slits, the second electrode layers being connected to the edge electrodes, respectively; and removing portions of the second electrode layers adjoining the portions of the edge electrodes by laser.

7. The method according to claim 5, wherein the protective layer is made of resin material.

8. The method according to claim 1, further comprising the step of forming a protective layer for covering at least one of the resistor elements.

9. The method according to claim 8, wherein the protective layer is made of resin material.

10. The method according to claim 1, wherein said step of forming the slits includes forming the slits by a dicing process.

11. The method according to claim 1, wherein said step of removing the portions of the edge electrodes is executed after said step of dividing the substrate into the strip substrates.

12. The method according to claim 1, wherein said step of removing the portions of the edge electrodes is executed before said step of dividing the substrate into strip substrates.

13. The method of manufacturing a multiple chip resistor according to claim 1, wherein said portions of the edge electrodes are removed and said gaps are formed without removing any portion of the multiple chip resistor below the first electrode layers.

* * * * *

UNITED STATES PATENT AND TRADEMARK OFFICE

CERTIFICATE OF CORRECTION

PATENT NO. : 7,237,324 B2
APPLICATION NO. : 10/474419
DATED : July 3, 2007
INVENTOR(S) : Toshiki Matsukawa et al.

It is certified that error appears in the above-identified patent and that said Letters Patent is hereby corrected as shown below:

Title Page, Item (56) References Cited, FOREIGN PATENT DOCUMENTS
Change "WO WO 0154143 A1 7/2001"
to -- WO 0154143 A1 7/2001 --

Signed and Sealed this

Eighteenth Day of December, 2007

JON W. DUDAS
*Director of the United States Patent and Trademark Office*